United States Patent [19]

Kalmanovitch

[11] 4,161,248

[45] Jul. 17, 1979

[54] CONTAINER FOR WIRE SPOOL

[75] Inventor: Martin Kalmanovitch, Montreal, Canada

[73] Assignee: Universal Wire & Cable Co. Ltd., Montreal, Canada

[21] Appl. No.: 840,787

[22] Filed: Oct. 11, 1977

[51] Int. Cl.[2] ..... B65D 85/04; B65D 85/66; B65D 21/02; B65D 51/02

[52] U.S. Cl. ..... 206/389; 206/508; 220/353

[58] Field of Search ..... 206/508, 389; 220/94 A, 220/353

[56] References Cited

U.S. PATENT DOCUMENTS

| | | | |
|---|---|---|---|
| 2,513,894 | 7/1950 | Rogers | 220/353 |
| 3,307,739 | 3/1967 | Cloyd | 206/508 |
| 3,516,571 | 6/1970 | Roper | 206/508 |
| 3,964,605 | 6/1976 | Vezirian | 220/353 |

FOREIGN PATENT DOCUMENTS

| | | | |
|---|---|---|---|
| 1201751 | 9/1965 | Fed. Rep. of Germany | 220/94 A |
| 2302239 | 9/1976 | France | 206/508 |
| 998634 | 7/1965 | United Kingdom | 206/389 |

*Primary Examiner*—George E. Lowrance
*Attorney, Agent, or Firm*—Alan Swabey; Guy J. Houle; Robert Mitchell

[57] ABSTRACT

A container for a wire spool adapted to be stacked one on top of the other without damage thereto or to its contents. The container comprises a spool housing having a side wall, a bottom wall and an open top end. A cover is provided for the open top end and is engageable about an outer peripheral edge of the open top end. A cover having load transfer ribs converging into a ring which is formed therein and which extends within the housing. The load transfer ring rests on an upper end of a wire spool, when provided in the housing, whereby external loads on the cover will be transmitted to the bottom wall of the housing through the load transfer ring and a core of the spool.

7 Claims, 7 Drawing Figures

Fig. 1
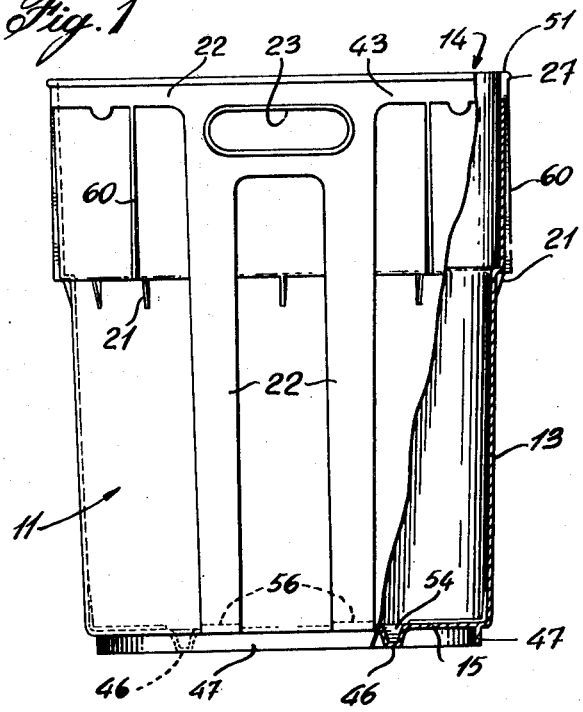
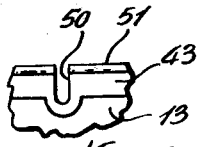
Fig. 3
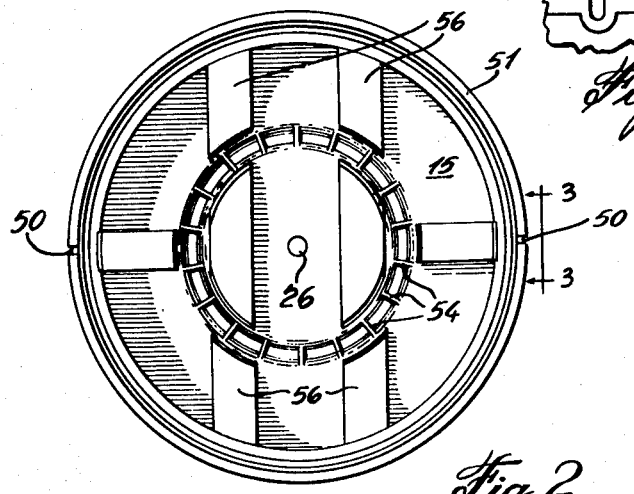
Fig. 2

CONTAINER FOR WIRE SPOOL

BACKGROUND OF THE INVENTION (a) Field of the Invention

The present invention relates to a container for storing, carrying and dispensing wire from a wire spool positioned therein and particularly to a container construction which permits the stacking thereof, one on top of the other, in a manner not to damage the container or its contents.

(b) Description of Prior art

Various types of containers for wire spools are known. For example, a particular type of container is constructed of cardboard material and provided with external metal handles on the side wall. A cardboard cover secures over the container to prevent dust from entering within the container. A disadvantage of this type of container is that they are weak in construction, have a very short life as they are susceptible to damage, do not permit safe stacking for shipping or storage, and will wear about the peripheral edge as wire is spun out of the wire core whilst the core is retained within the container. Also, being of cardboard construction, the container will absorb moisture and further being of cylindrical shape will not permit containers to be stacked one within the other and therefore require a larger area for shipping or storage when there is no wire spool within the container.

SUMMARY OF INVENTION

It is a feature of the present invention to provide a container for a wire spool which substantially overcomes all of the above-mentioned disadvantages.

It is a further feature of the present invention to provide a container for a wire spool and wherein the container with spools are stackable one on top of the other without damage to the container as the load distribution is directed on the core of the wire spool via the cover and bottom wall of the container which are made with interfitting portions.

A further feature of the present invention is to provide a container for wire spool and cover therefor which are stackable one within each other, respectively.

A further feature of the present invention is to provide an improved container for a wire spool which is long lasting and which provides additional features over the prior art.

According to the above features, from a broad aspect, the present invention provides a container for a wire spool which comprises a spool housing having a side wall, a bottom wall and an open top end. A cover is provided for the open top end. The cover is engageable about an outer peripheral edge of the open top end. Load transfer means is provided in the cover and extends within the housing. The load transfer means rests on an upper end of the wire spool when provided in the housing whereby external loads on the cover will be transmitted to the bottom wall through the load transfer means and a core of the spool.

BRIEF DESCRIPTION OF DRAWINGS

A preferred embodiment of the present invention will now be described with reference to the accompanying drawings in which:

FIG. 1 is a side view of the container spool housing partly fragmented;

FIG. 2 is a top view looking in the interior of the spool housing;

FIG. 3 is a fragmented view along section line 3—3 of FIG. 2;

DESCRIPTION OF PREFERRED EMBODIMENTS

Figure 4:
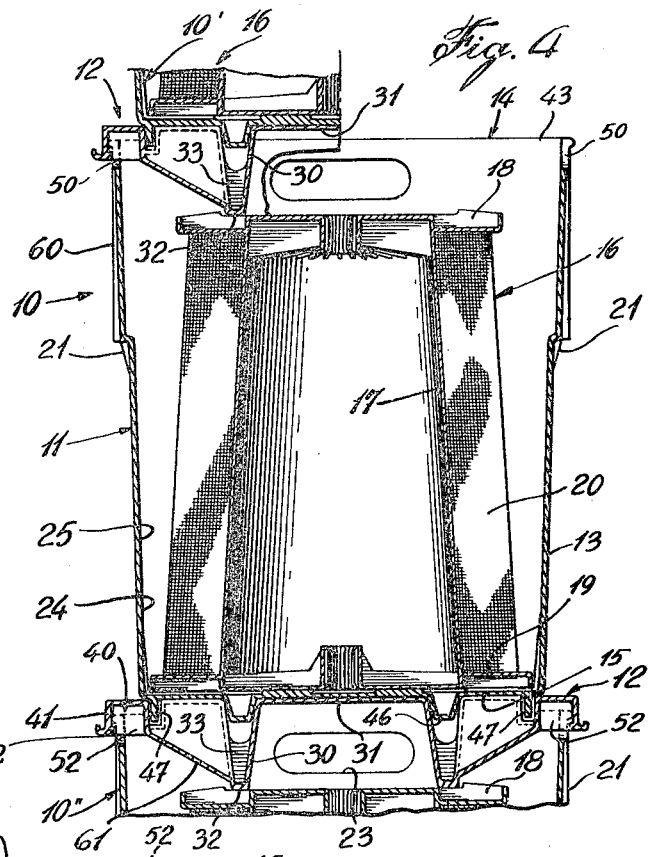
FIG. 4 is a sectional side view showing the stacking feature of the container of the present invention with a wire spool positioned therein to illustrate the vertical load transfer.

Referring to the drawings and more particularly to FIGS. 1 and 4 there is shown generally at 10 (FIG. 4) the container of the present invention comprising a spool housing 11 and a cover 12. The spool housing 11 has a tapered cylindrical side wall 13 which tapers inwardly from an open top end 14, to a bottom wall 15.

The container 10 is particularly adapted for storing and transporting wire spools, such as the type illustrated at 16, the spools comprising essentially a spool core 17 having an upper flange 18 and a lower flange 19 with a body of wire 20 wound about the core 17 and between the flanges 18 and 19. The spool housing 11 and cover 12 are both molded of a rigid plastic material. In order to reinforce the spool housing 11, structural ribs 21 are provided thereabout. The ribs 60 about the upper part of the sidewall are to prevent the housing 11 to interlock or wedge into one another when empty housings 11 are stacked together. Opposed hand holes 23 are provides in the sidewall 13 adjacent and spaced from the top end 14. These are integrally formed in the sidewall.

The spool housing 11 is further provided with vertically extending, downwardly outwardly tapering, centering ribs 24 which are located in a spaced-apart manner about the inner surface 25 of the side wall 13 adjacent the bottom wall 15 whereby when a wire spool is lowered into the spool housing 11 the bottom flange 19 will be placed concentrically within the container and spaced a minimum distance away from the inner surface 25. The reason for this is to provide sufficient spacing between the inner surface 25 close to the top of the wire spool 16 to provide for the drawing or spin-out of wire from the body of wire 20 through the open top end 14. Additionally, the spool housing 11 is provided with a moisture escape hole 26 in the bottom wall 15 thereof (see FIG. 2). Also, the hole 26 renders the housing 11 useless as a bucket for storing liquids. A cover engaging rim 27 also extends about the upper peripheral edge of the housing for frictional engagement with the cover 12, as will be described later.

Figure 5:
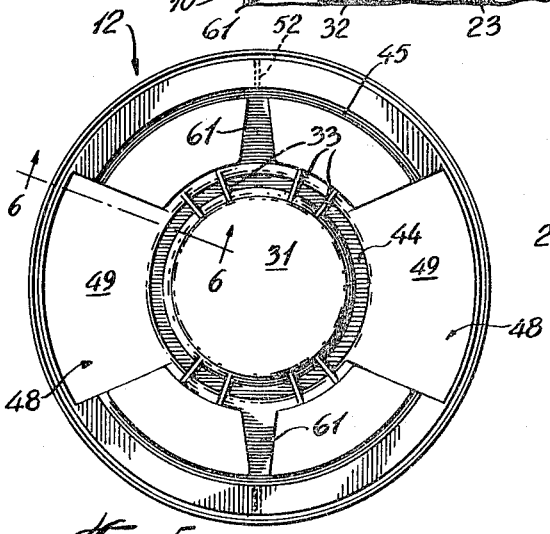
FIG. 5 is a top view of the cover for the spool housing.

Referring now more particularly to FIGS. 4 and 5, there is shown the construction of the cover 12. The cover is formed with load transfer ribs 61 which converge to load transfer rib or ring 30 which extends above an inner face 31 of the cover and terminates in a flat external end 32 whereby to rest on an upper end of the upper flange 18 or top part of the core of the wire spool 16 when positioned in the container housing 11. The load transfer ring 30 is reinforced by structural ribs 33 extending transversely thereacross, as better seen in FIG. 5. As can be seen the load transfer ring 30 is inverted cup-shaped whereby to transfer the load of a container 10' positioned thereover. The transfer ring will distribute this load circumferentially on the upper end of the wire spool and substantially in alignment with the cylindrical core 17 of the spool which is the most rigid part of the spool, and through this core and lower flange 19, onto the bottom wall 15. As shown in FIG. 4 the load of the top container 10' is transferred through the core 17 and onto the cover 12 of a lower container 10''.

The cover 12 is further provided with a peripheral floating joint 40 which permits vertical displacement of the cover 12 about the open top end 14 of the spool housing 11 to accommodate in the housing spools having cores of varying height. The floating joint is formed by a peripheral vertical end wall 41 having a friction member or bead 42 for frictional engagement with a portion of the top outer surface 43 of the spool housing side wall 13 and adjacent the open top end 14. Cover engaging rim 27 frictionally engages with the inner face of the vertical end wall 41 and cooperates with the annular friction rib 42 to provide a friction seal about the open top end and limit the vertical displacement of the cover 12 about the open top end 14. Of course, depending on the amount of vertical adjustment required to accommodate a range of varying size wire spools 16, the peripheral vertical end wall 41 may vary in length.

The cover is still further provided with one or more alignment cavities 44 and 45 in the top surface thereof to receive one or more alignment protrusions, herein an inner support rim 46 and an outer support flange 47, formed in the outer face of the bottom wall 15. This provides interengagement and centering of containers 10 when positioned one on top of the other as clearly shown in FIG. 4. The cavity 44 is provided by the inner area of the load transfer ring 30 whilst the cavity 45 is formed in the upper surface of the cover between hand hole cavities 48 which are diametrically opposed in the cover. The cavities and protrusions are also concentrically disposed relative to one another.

Figure 6:
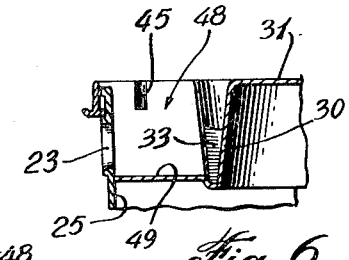
FIG. 6 is a fragmented sectional view along section line 6—6 of FIG. 5.
Figure 7:
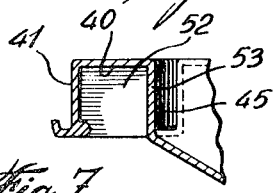
FIG. 7 is a fragmented sectional view showing the alignment ribs provided in the cover and engageable within the alignment slot as shown in FIG. 3.

Referring now more particularly to FIGS. 5 and 6, there is shown the construction of the hand hole cavities 48 within the cover 12. Each cavity has a bottom wall 49 which is closely spaced at an outer peripheral edge with the inner surface 25 of the side wall 13 of the spool housing 11. The bottom wall 49 extends below the hand hole 23 to permit the insertion of fingers of a hand therethrough to manipulate the container. In order to ensure that the hand hole cavities 48 are in alignment with the hand holes 23 there is provided two alignment slots 50 diametrically opposed in the upper peripheral edge 51 of the open top end 14 (see FIGS. 2 and 3). These aligning slots receive a respective alignment rib 52 (see FIG. 7) which extends perpendicular to the planar axis of the cover 12 from the peripheral vertical end wall to an opposed wall 53 which define therebetween the floating joint previously mentioned. Thus, to engage the cover 12 about the open top end 14 of the housing 11 the ribs 52 are aligned with each slot 50 and the cover is depressed over the top end 14 causing the end walls 41 to flex outwardly until the friction rib 42 snaps under the cover retaining flange 27. The resiliency of the material of the cover will maintain pressure between the friction rib 42 and the upper outer surface of the container housing. The slots 50 also allow the section 43 of the housing 11 to compress slightly when the cover is being depressed.

It is within the ambit of the present invention to provide any obvious modification thereof provided these fall within the scope of the broad claims appended hereto. For example, various other structural ribs may be provided to further solidify the container. In FIG. 2 there is shown structural ribs 54 extending transversely within the cavity defined by the inner support rim 46. Further, the shape of the side wall, which is of uniform thickness, can be modified, while retaining the interfitting feature of the present invention, to provide a larger area in the upper end of the spool to further facilitate the drawing of wire from the spool core or for other reasons.

The upper portion of prior art containers have been designed to internally accommodate the standard industry "Graham Magnet" wire payoff device, whilst the present container will receive such device in an external fit. The advantages of the external fit are:

(a) wire as it is being paid off will rub against the smooth cylindrical metal walls of the "Graham Magnet" unit, thus preventing wear of the inner wall of the container by the wire, (b) fitting the payoff unit over the container will not damage the top rim of the container, as it did to prior art cardboard containers, (c) the container being tapered will accept less than perfectly circular payoff units.

I claim:

1. The combination of a spool for metal wire and the like and a container for said spool; said spool having a core and upper and lower flanges at the opposite ends thereof; said container comprising a housing and a removable cover; said housing having a side wall, a bottom wall and an open top end; said spool being disposed entirely within said housing with said lower flange being seated on said bottom wall, said upper flange being recessed below the housing top end; said cover closing said housing open top end and including a depending wall having a portion in sealing sliding engagement with the exterior of said housing side wall defining a floating joint between said cover and said housing permitting vertical displacement of said cover relative to said housing while frictionally engaging said housing to accommodate spools of different heights; and said cover having load transfer means depending into said housing and being directly seated on said upper flange with said spool directly transferring loads between said cover and said bottom wall independently of said housing side wall.

2. The combination of claim 1 wherein said load transfer means is in the form of a hollow ring having a flat lower end seated on said upper flange, and said bottom wall has a depending support rim of a size and position for seating in the hollow ring of an underlying cover and assuring alignment of stacked containers.

3. A combination as claimed in claim 2 wherein an outer support flange is provided in said bottom wall and disposed concentrically about said support rim.

4. A combination as claimed in claim 1, wherein said peripheral floating joint is formed by a peripheral vertical end wall of said cover, said end wall having a friction member for frictional engagement with said peripheral portion of said top end of said side wall adjacent said open top end.

5. A combination as claimed in claim 4, wherein said top end of said housing has a cover engaging rim, said friction member being an annular friction rib displaceable about said peripheral portion of said housing side wall below said engaging rim whereby said engaging rim limits upper vertical displacement of said cover and frictionally engages an inner face of said peripheral vertical end wall to constitute a double friction seal with said annular friction rib.

6. A combination as claimed in claim 4, wherein one or more vertical aligning slots are provided in said outer peripheral edge of said open top end, and one or more cover alignment ribs extending perpendicular to the planar axis of said cover from said peripheral vertical end wall thereof, said one or more cover alignment ribs extending into a respective one of said one or more vertical aligning slots when said cover is engaged about said outer peripheral edge of said open top end.

7. A combination as claimed in claim 6, wherein said cover is provided with diametrically opposed hand hole cavities each having a cavity bottom wall to engage at an outer peripheral edge with an inner surface of said side wall of said spool housing below an associated hand hole of two hand holes diametrically opposed in said side wall spaced from said outer peripheral edge of said open top end, said aligning slots and alignment ribs positioning said hand hole cavities adjacent a respective one of said hand holes.

* * * * *